US008714055B2

(12) United States Patent
Chen

(10) Patent No.: US 8,714,055 B2
(45) Date of Patent: May 6, 2014

(54) ONE-WAY RATCHET WHEEL ELEMENT

(76) Inventor: Cheng-Kun Chen, Tianzhong Township, Changhua County (TW)

( * ) Notice: Subject to any disclaimer, the term of this patent is extended or adjusted under 35 U.S.C. 154(b) by 367 days.

(21) Appl. No.: 13/290,352

(22) Filed: Nov. 7, 2011

(65) Prior Publication Data

US 2012/0132037 A1 May 31, 2012

(30) Foreign Application Priority Data

Nov. 25, 2010 (TW) ..... 99140868 A

(51) Int. Cl.
*B25B 13/00* (2006.01)
*B25B 13/46* (2006.01)

(52) U.S. Cl.
CPC ..... *B25B 13/00* (2013.01); *B25B 13/46* (2013.01); *B25B 13/463* (2013.01)
USPC ..... 81/60; 81/59.1

(58) Field of Classification Search
CPC ..... B25B 13/00; B25B 13/46; B25B 13/463
USPC ..... 81/59.1, 60
See application file for complete search history.

(56) References Cited

U.S. PATENT DOCUMENTS 4,991,468 A * 2/1991 Lee ..... 81/60
6,134,990 A * 10/2000 Ling et al. ..... 81/60
6,988,429 B2 * 1/2006 Lee et al. ..... 81/63.2

* cited by examiner

*Primary Examiner* — Lee D Wilson
*Assistant Examiner* — Danny Hong
(74) *Attorney, Agent, or Firm* — Muncy, Geissler, Olds & Lowe, P.C.

(57) ABSTRACT

A one-way ratchet wheel element has engaged and linked driving wheel and driven wheel in a body. The side of the body that connects with the driving wheel has a shifting space. A tooth section is provided on a wedge opposite to the shifting space. When the driven wheel rolls and engages with the tooth section, there is a resistance to the rotation of the driving wheel, forming an engagement state. When the driven wheel is away from the tooth section on the wedge, it is in the idle state.

7 Claims, 8 Drawing Sheets

ONE-WAY RATCHET WHEEL ELEMENT

BACKGROUND OF THE INVENTION

1. Field of Invention

The invention relates to a ratchet wheel structure and, in particular, to a one-way ratchet wheel element that has tighter engagement in operations.

2. Related Art

FIG. 11 shows a conventional one-way driving mechanism used on a wrench. One end of the wrench 91 has an accommodating hole 92 with a ratchet wheel block 93. The ratchet wheel block 93 is surrounded by several slant depressions 94. Several transmission spaces 95 are formed between the slant depressions 94 and the inner wall of the accommodating hole 92. Each of the transmission spaces 95 is disposed with a rolling column 96, which engages one side of the inner wall of the accommodating hole 92 in one way. Therefore, the wrench can drive the ratchet wheel block 93 and the element it mounts on. However, the force rests mainly on the edge of the ratchet wheel block 93 because of the structure of the ratchet wrench. It is likely to result in aberrations. Moreover, if the exerted force is too large, the rolling column 96 is likely to slip. The symmetric structure also renders a thick wrench body. The torque resistance is far lower than the conventional ratchet wheel wrench. Such a tool has to be specially treated to strengthen the structure in order to satisfy the torque resistance standard. The cost thus cannot be reduced.

SUMMARY OF THE INVENTION

An objective of the invention is to provide a one-way ratchet wheel element that engages with ratchet teeth through a slant surface, thereby providing better strength and torque resistance. The disclosed ratchet wheel element achieves a firmer grasp without slipping.

Another objective of the invention is to provide a one-way ratchet wheel element that achieves almost stepless driving, suitable for working in narrow workspace.

Yet another objective of the invention is to provide a one-way ratchet wheel element that is applicable to all wrenches, flywheels, one-way bearings, or ratchet wheel-type chair backs that involve one-way driving mechanisms.

To achieve the above-mentioned objectives, the disclosed one-way ratchet wheel element includes: a body and a driven wheel.

The body has a first hole and a second hole. The first hole is provided with a driving wheel whose central part is formed with a transmission part for driving a rotating element. The outer surrounding surface of the driving wheel is formed with a first tooth part. The direction for the body to drive the driving wheel is defined as a driving direction. The second hole has a shifting space on the side toward the driving direction. The opposite wedge on the other side of the shifting space has an engaging tooth section formed with continuously multiple small teeth.

The driven wheel is disposed in the second hole of the body. The outer surrounding surface of the driven wheel is formed with a second tooth part for engagement with the first tooth part, and a blocking tooth part for engagement with the engaging tooth section of the second hole. The driven wheel is driven by the driving wheel to roll toward the engaging tooth section on the wedge on the opposite side of the shifting space. The blocking tooth part thereof thus engages with the engaging tooth section. When the body rotates opposite to the driving direction, the blocking tooth part of the driven wheel rolls away from the engaging tooth section on the opposite wedge, entering an idle state.

BRIEF DESCRIPTION OF THE DRAWINGS

These and other features, aspects and advantages of the invention will become apparent by reference to the following description and accompanying drawings which are given by way of illustration only, and thus are not limitative of the invention, and wherein.

DETAILED DESCRIPTION OF THE INVENTION

The present invention will be apparent from the following detailed description, which proceeds with reference to the accompanying drawings, wherein the same references relate to the same elements.

Figure 1:
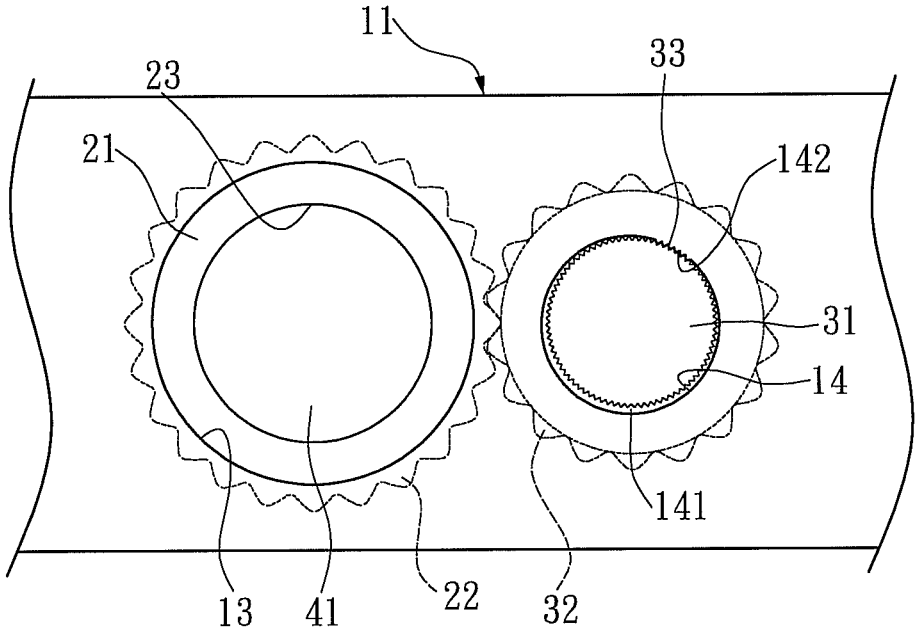
FIG. 1 shows the structure of the invention.

Please refer to FIG. 1. The one-way ratchet wheel element according to the invention has a body 11, a driving wheel 21, and a driven wheel 31.

The body 11 has a first hole 13 and a second hole 14. The first hole 13 is disposed with a driving wheel 21 whose central part is formed with a transmission part 23 for driving a rotating element 41. The rotating element 41 can be a transmission axle or a screwing element. The outer surrounding surface of the driving wheel 21 is formed with a first tooth part 22. The direction for the body 11 to rotate the driving wheel 21 is defined as a driving direction R. The side of the second hole 14 toward the driving direction R has a shifting space 141. The wedge of the second hole 14 on the opposite side of the shifting space is provided with an engaging tooth section 142 with continuously multiple small teeth.

The driven wheel 31 is disposed in the second hole 14 of the body 11. The outer surrounding surface of the driven wheel 31 is formed with a second tooth part 32 for engagement with the first tooth part 22, and a blocking tooth part 33 for engagement with the engaging tooth section 142 of the second hole 14. The driven wheel 31 is driven by the driving wheel 11 to roll toward the engaging tooth section 142 on the wedge on the opposite side of the shifting space 141. The blocking tooth part 33 thereof engages with the engaging tooth section 142. When the driving wheel 21 drives the driven wheel 31 to roll and engage with the engaging tooth section 142 on the opposite wedge, a wedge reaction is produced to stop the driving wheel 21 from further rotation and to cancel the torque effects of the driving ratchet wheel, resulting in an engagement state.

When the body 11 rotates in the direction opposite to the driving direction R, the blocking tooth part 33 of the driven wheel 21 rolls away from the engaging tooth section 142. In this case, since the reaction of the wedge disappears, the driving wheel 21 can perform idle rotations, thereby resulting in one-way driving.

Figure 2:
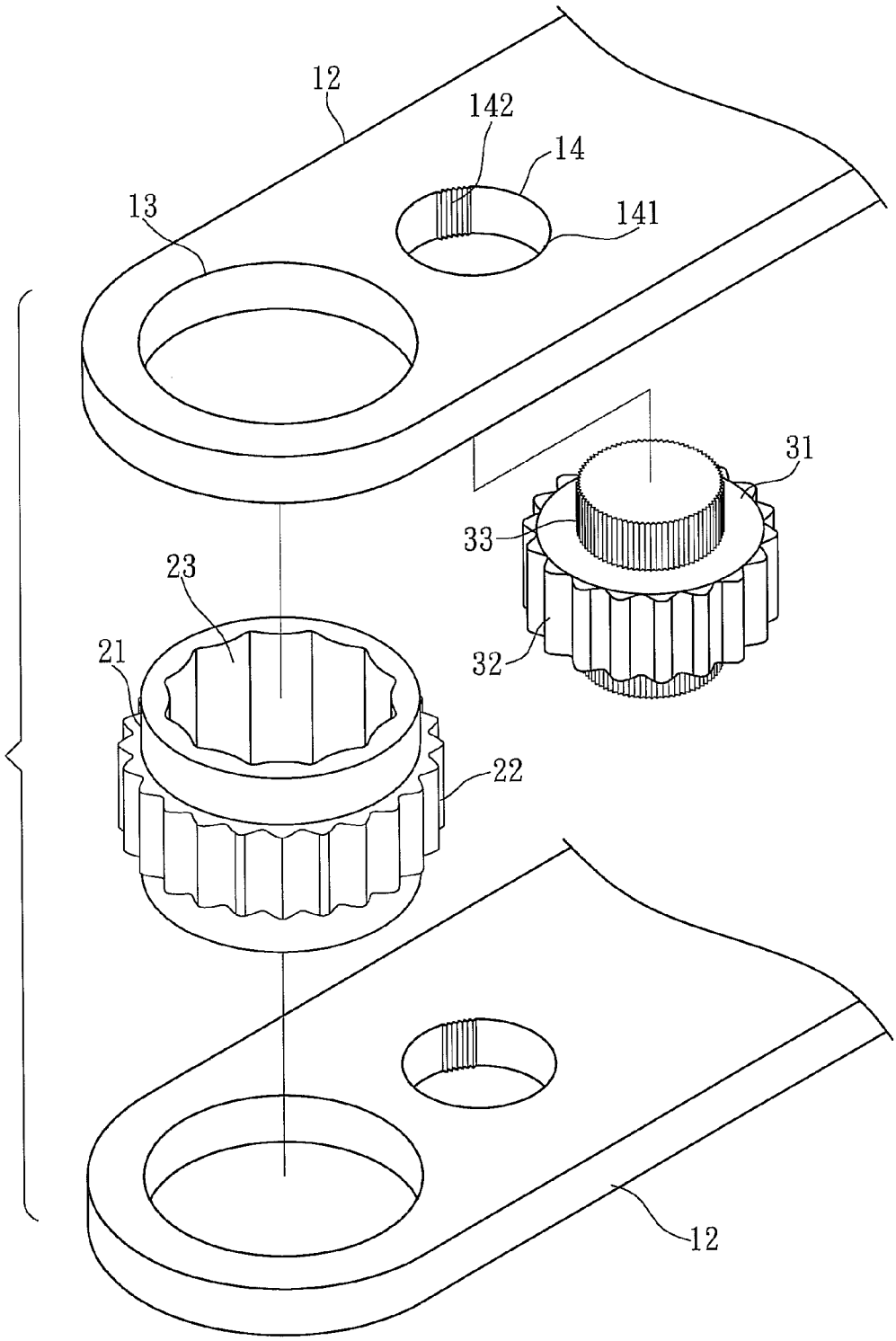
FIG. 2 is a three-dimensional exploded view of the first embodiment of the invention.
Figure 3:
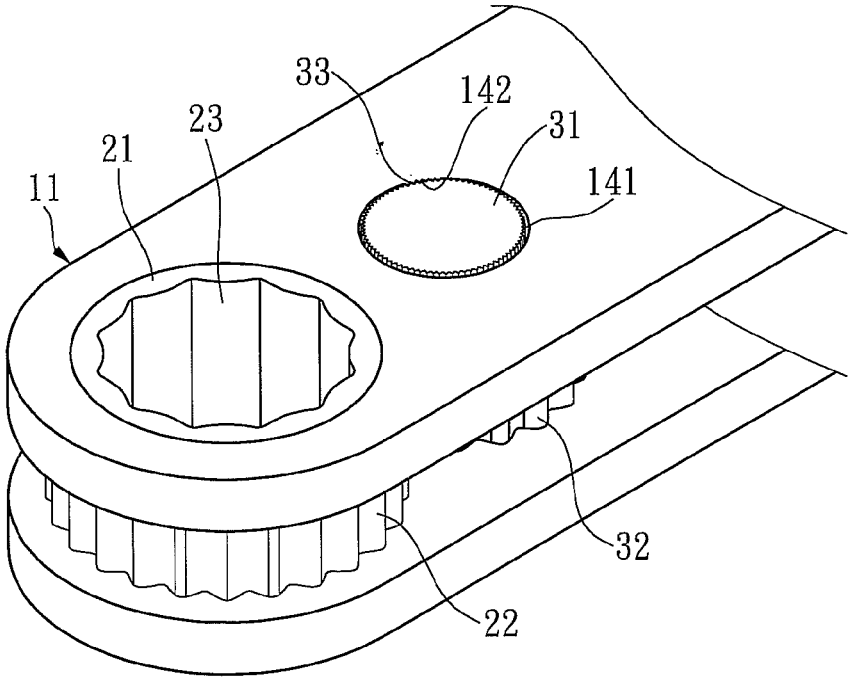
FIG. 3 is a three-dimensional view of the first embodiment after assembly.
Figure 4:
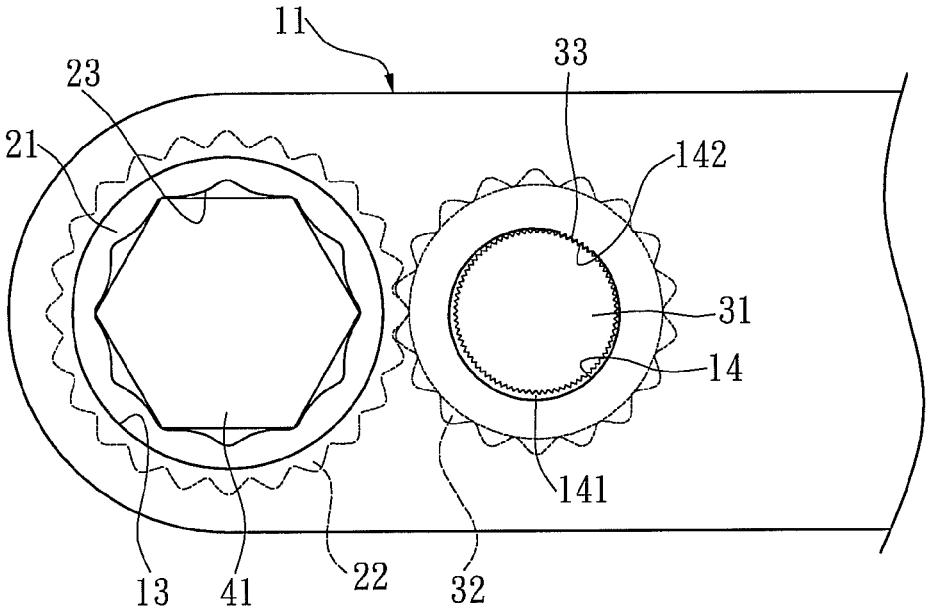
FIG. 4 is a structural view of the first embodiment.

Please refer to FIGS. 2 to 4 for a first embodiment of the invention applied to a wrench. It consists of a body 11, a driving wheel 21, and a driven wheel 31.

The body 11 in this embodiment consists of two opposite sideboards 12. The end surfaces of the two sideboards 12 of the body 11 are formed with a first hole 13 and a second hole 14, which are not connected. The driving wheel 21 is sandwiched between the first holes 13 of the two sideboards 12. The surrounding surface of the driving wheel 21 is formed with a first tooth part 22. The central part of the driving wheel 21 is formed with a transmission part 23 that rotates a rotating element 41. In this embodiment, the rotating element 41 is a screwing tool. The direction for the body 11 to rotate the screwing tool is defined as a driving direction R. The side of the second hole 14 toward the driving direction R has a shifting space 141. The opposite wedge of the second hole on the other side of the shifting space 141 is formed with an engaging tooth section 142 composed of a plurality of small teeth. The engaging tooth section 142 has 60 to 100 small teeth. In this embodiment, the engaging tooth section 142 has 90 small teeth.

The driven wheel 31 is sandwiched between the second holes 14 of the two sideboards 12. The outer surrounding surface of the driven wheel 31 is formed with a second tooth part 32 and a blocking tooth part 33. The second tooth part 32 and the blocking tooth part 33 surround the outer surrounding surface of the driven wheel at different heights. The second tooth part 32 engages with the first tooth part 22 of the driving wheel 21 between the two sideboards 12 so that power can be transmitted in between. The blocking tooth part 33 in this embodiment also has 90 small teeth. When the body 11 rotates toward the driving direction R, the driven wheel 31 is driven by the driving wheel 21 to roll toward the engaging tooth section 142 on the opposite wedge on the other side of the shifting space 141. The blocking tooth part 33 then engages with the engaging tooth section 142, providing a resistance to the rotation of the driving wheel 21. Since the diameter of the driving wheel 21 is greater than the driven wheel 31, the blocking tooth part 33 of the driven wheel 31 effectively has a few times more teeth when the driving wheel 21 rotates the driven wheel 31.

Figure 5:
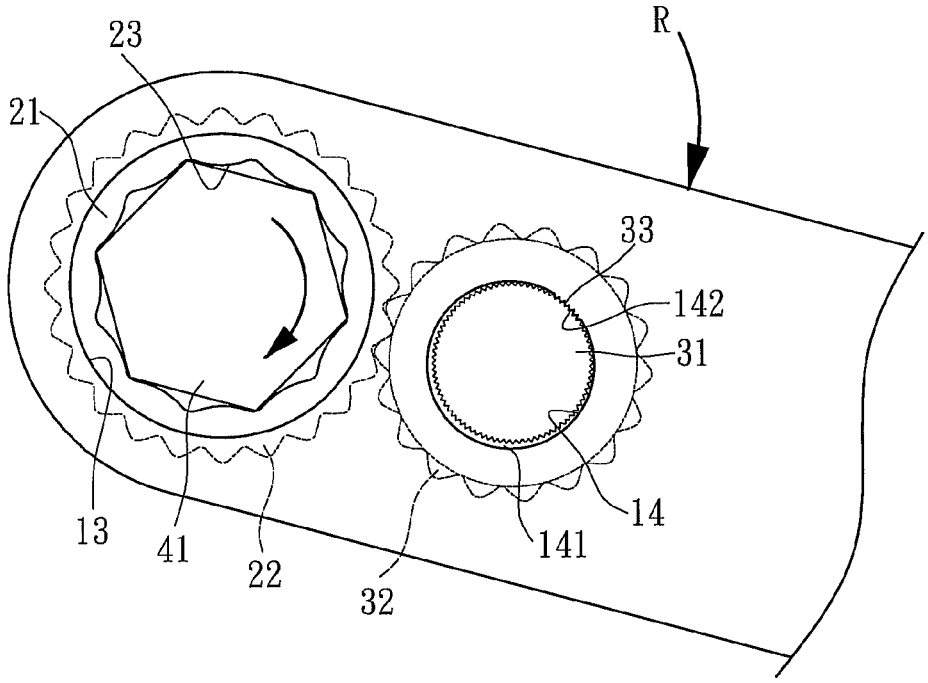
FIG. 5 shows the first embodiment in use when the body rotates toward the driving direction.

Please refer to FIG. 5. In practice, when a user connects the transmission part 23 of the driving wheel 21 of the invention to a screwing tool 41 and exerts a force to rotate the body 11 toward the driving direction R, the driving wheel 21 drives the driven wheel 31 to roll toward the engaging tooth section 142 on the opposite wedge on the other side of the shifting space 141, engaging the blocking tooth part 33 with the engaging tooth section 142. When the driving wheel 21 rolls the driven wheel 31 to engage with the engaging tooth section 142 on the opposite wedge, a wedge reaction is formed to firmly stop the driving wheel 21 from rotating, eventually cancelling the torque of the driving ratchet wheel. This forms the engagement state. When the body 11 rotates toward the driving direction R, the user can simultaneously drive the screwing tool 41 connected to the transmission part 23 of the driving wheel 21 for fastening or loosening processes.

Figure 6:
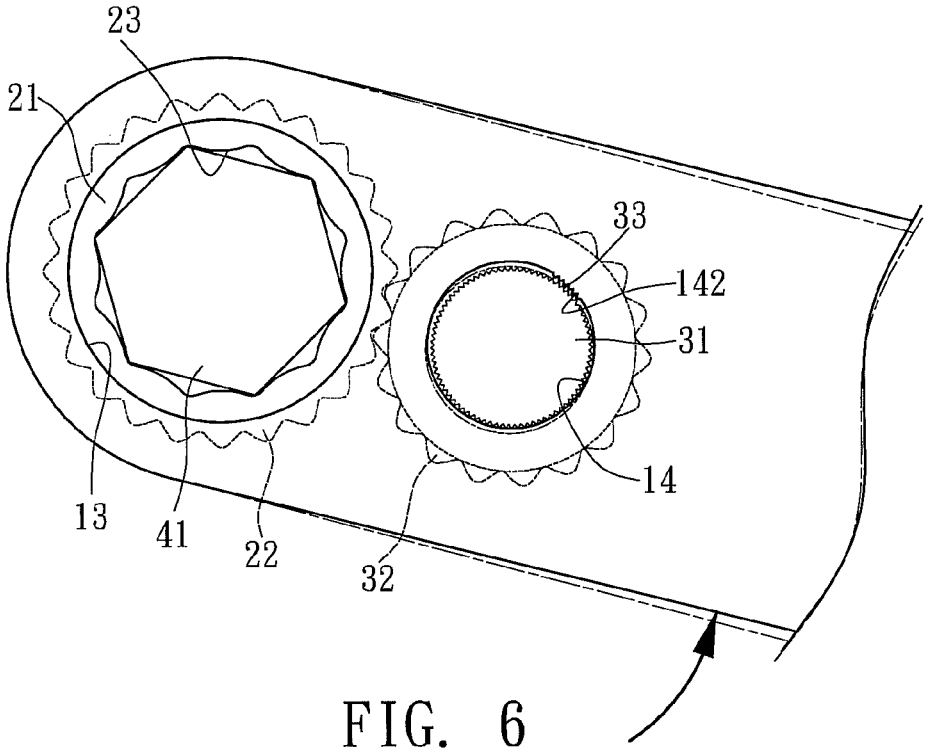
FIG. 6 shows the first embodiment in use when the body rotates opposite to the driving direction.

When the user changes the direction of imposed force so that the body 11 of the wrench rotates opposite to the driving direction R, as shown in FIG. 6, the blocking tooth part 33 of the driven wheel 31 rolls away from the engaging tooth section 142 of the second holes 14 and toward the shifting space 141, thereby disengaging the engaging tooth section 142 of the second holes 14. Since the wedge reaction disappear in this case, the body 11 does not drive the screwing tool 41 when it rotates backwards. The body 11 is thus idle relative to the driving wheel, achieving the goal of one-way driving.

It should be emphasized that in comparison with the conventional ratchet wheel wrench, the invention utilizes the wedge effect to achieve one-way driving. There is no need to use additional elastic elements to urge a restraining block. The structure is simpler and the assembly is easier. As the blocking tooth part 33 of the driven wheel 31 engages with the engaging tooth section 142 of the second holes 14 as the body 11 rotates along the driving direction R, the wedge reaction becomes bigger as the force imposed by the user along the driving direction R gets larger because of the configuration of the engaging tooth section 142 and the blocking tooth section 33. This makes the invention less likely to slip in use. Therefore, even the engaging tooth section 142 and the blocking tooth section 33 have 60 to 100 small teeth, one does not need to worry about insufficient strength or resistance torque. Under the action of the driving wheel 21, the driven wheel 31 effectively has a few times more teeth. This reduces the required angle for works. The wrench thus formed is more close to stepless and suitable for narrow workspace.

Figure 7:
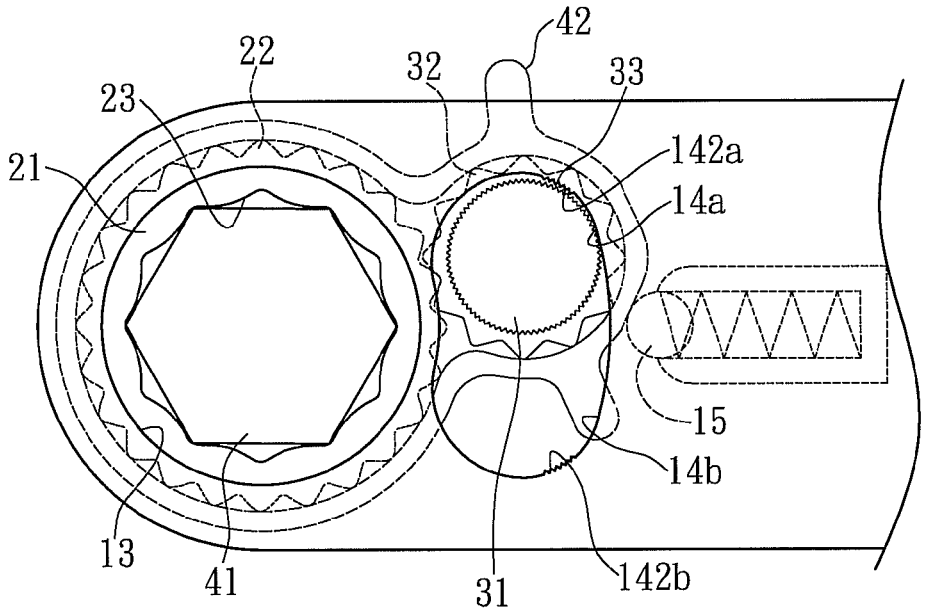
FIG. 7 is a structural view of the second embodiment.

FIG. 7 shows a second embodiment of the invention on a wrench. This embodiment differs from the first embodiment in that the second holes 14 are further divided into a first interval 14*a* and a second interval 14*b*, respectively. The side of the body 11 opposite to the second holes 14 is provided with an elastic urging element 15 connected to the second holes. The outer surrounding surface of the driving wheel 21 and the driven wheel 31 is provided with a switching element 42, so that the driven wheel 31 can switch between the first interval 14*a* and the second interval 14*b*. The elastic urging element 15 urges against one side of the switching element 42, restricting the driven wheel 31 in one of the intervals 14*a*, 14*b*. The two intervals 14*a*, 14*b* are formed with engaging tooth sections 142*a*, 142*b* disposed in reverse, respectively.

Figure 8:
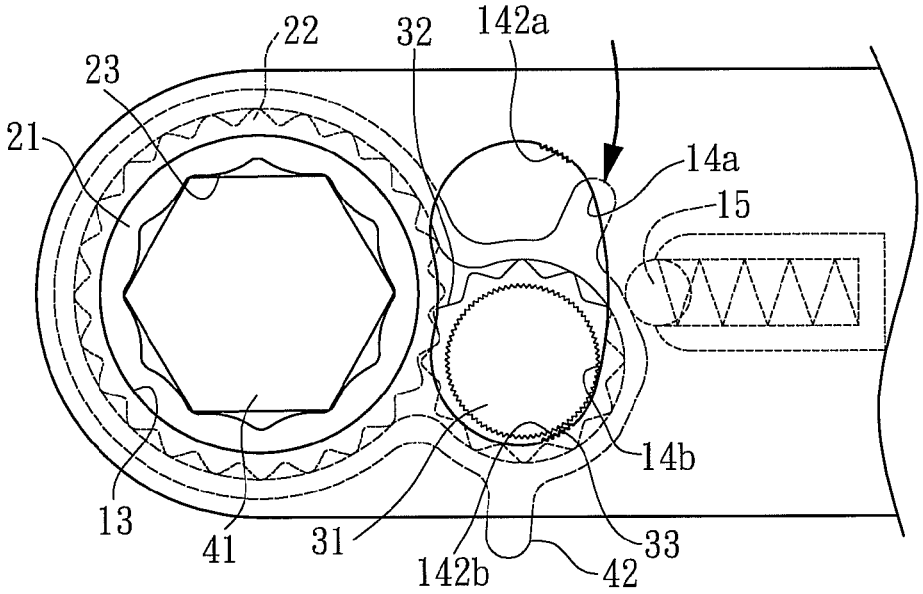
FIG. 8 shows the second embodiment in use when the driven wheel is switched.
Figure 9:
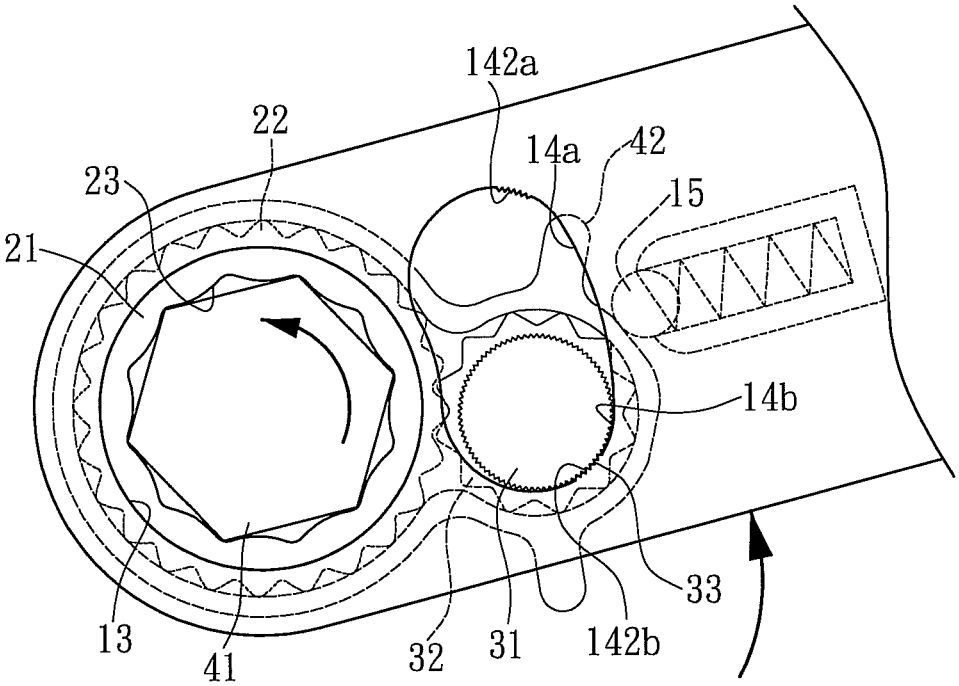
FIG. 9 shows the second embodiment in use when the body rotates in reverse.

If the user wants to change the rotating direction of the tool 41 with the wrench, as shown in FIG. 8, he or she only needs to press the switching element 42 so that the driven wheel 31 is accommodated in the second interval 14*b* of the second holes 14. In this case, the engaging tooth section 142*b* of the second interval 14*b* is opposite to the engaging tooth section 142*a* of the first interval 14*a*. Therefore, when the user rotates the body 11 in reverse, as shown in FIG. 9, the driven wheel 31 is brought by the driving wheel 21 to roll toward the engaging tooth section 142*b* of the second interval 14*b*. The blocking tooth part 33 engages with the engaging tooth section 142*b* on the opposite wedge, thereby blocking the rotation of the driving wheel 21. If in this state the user further rotates the body 11 forward, the blocking tooth part 33 of the driven wheel 31 rolls away from the engaging tooth section 142*b* on the opposite wedge and toward the shifting space 141, thereby releasing the engagement with the engaging tooth section 142*b* of the second interval 14*b*. Since the reaction from the wedge disappears now, the body 11 can freely rotate with respect to the driving wheel 21. By switching the relative position of the driven wheel 31 to the two intervals 14*a*, 14*b*, the driving direction of the wrench can be changed in opposite directions.

Figure 10:
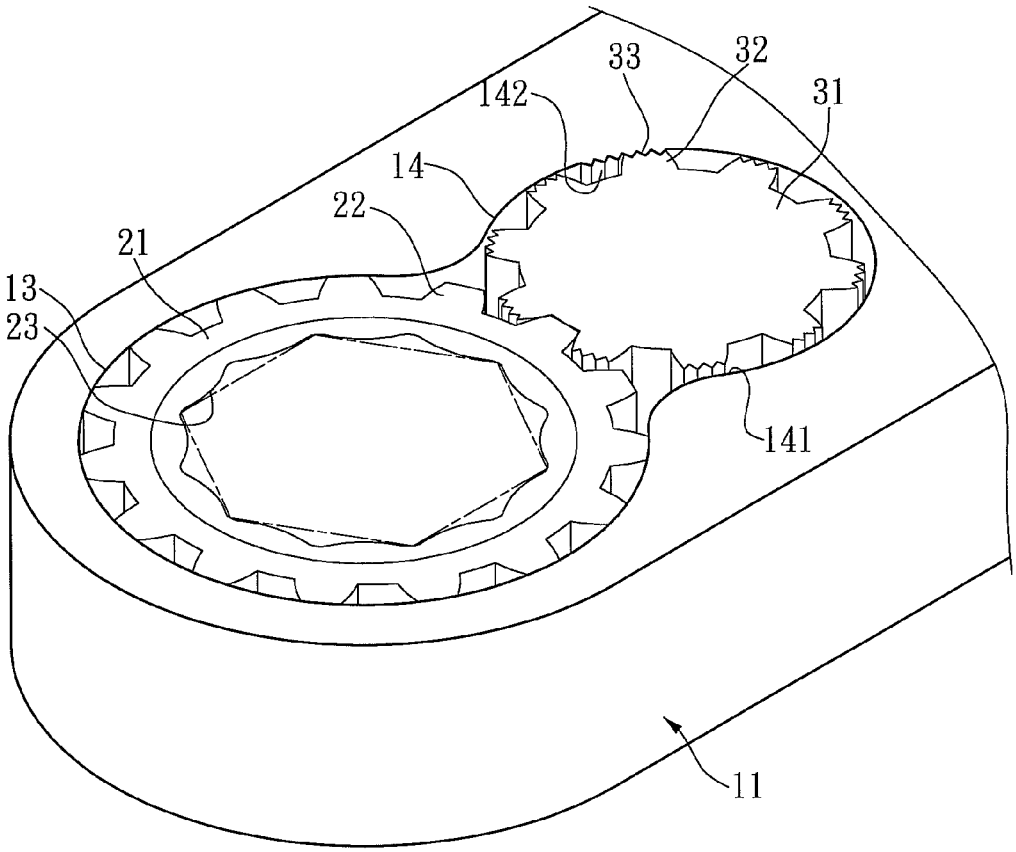
FIG. 10 is a structural view of the third embodiment.
Figure 11:
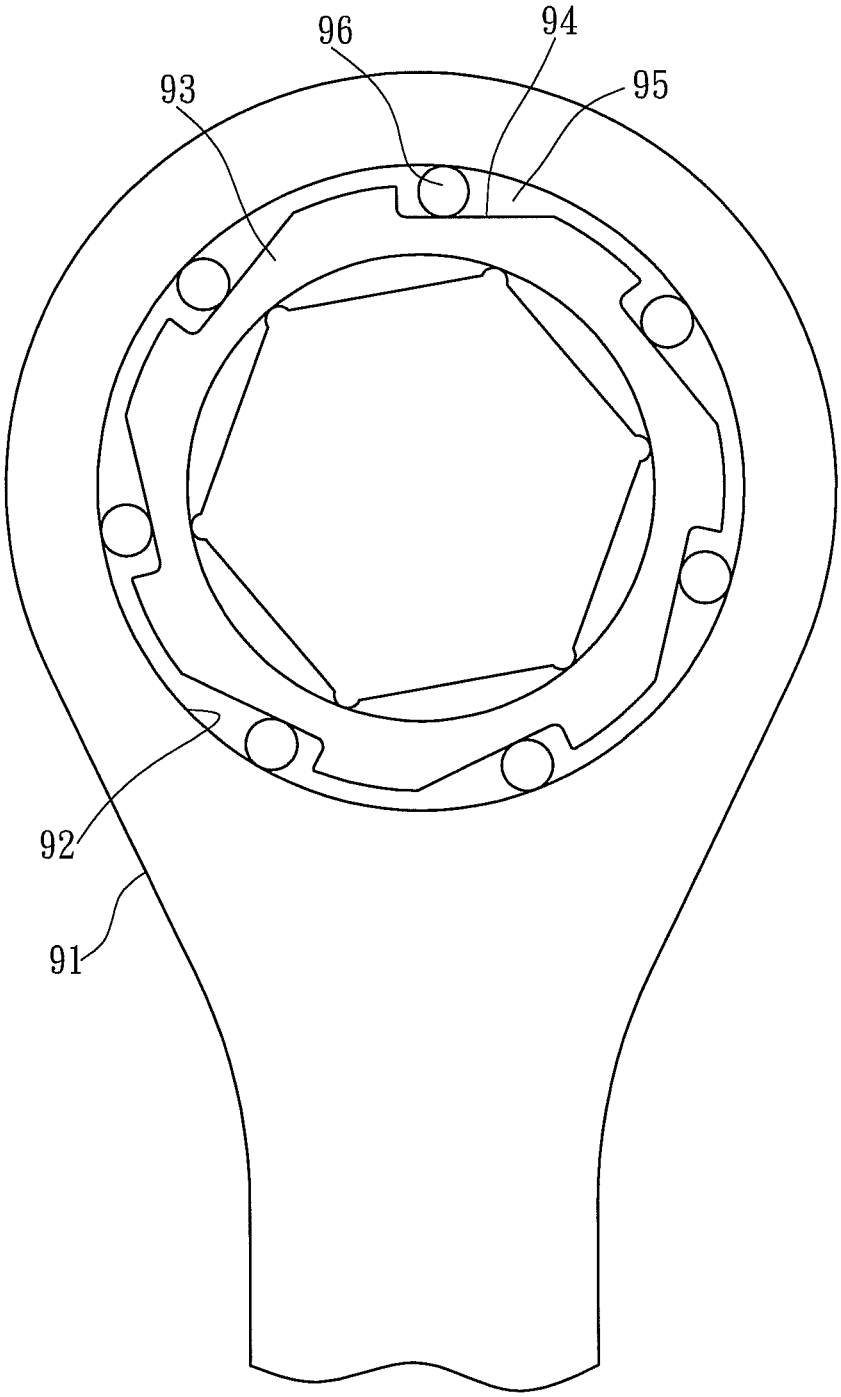
FIG. 11 PRIOR ART
FIG. 11 shows the structure of a conventional stepless ratchet wheel wrench.

FIG. 10 shows a third embodiment of the invention on another wrench. This differs from the first embodiment in that the body 11 is integrally formed with a first hole 13 and a second hole 14 that are connected with each other. The outer surrounding surface of the driving wheel 21 is formed with a first tooth part. The driving wheel is accommodated in the first hole 13. The outer surrounding surface of the driven wheel 31 is formed with a second tooth part 32 to engage with the first tooth part 22. The end portion of each of the tooth peaks of the second tooth part 32 has a blocking tooth part 33 composed of several small teeth. The second tooth part 32 and the blocking tooth part 33 surround the outer surrounding surface of the driven wheel 31 at the same height.

With the third embodiment of the invention, the driven wheel 31 is also driven by the driving wheel 21 to roll toward the engaging tooth section 142 on the opposite wedge on the other side of the shifting space 141 of the second hole 14 when the body 11 rotates toward the driving direction R. The blocking tooth part 33 thereof engages with the engaging tooth section 142, providing a resistance to the rotation of the driving wheel 21. This achieves the goal of one-way driving. This shows that the disclosed one-way ratchet wheel element is not limited to the kind or shape of the body 11 and applicable to all types of wrenches.

Likewise, the disclosed one-way ratchet wheel element is also applicable to the one-way bearing of bicycle flywheels or ratchet wheel-type chair back that uses a one-way driving mechanism. One only needs to connect the transmission part 23 of the driving wheel 21 and the pivotal axis of the one-way bearing or ratchet wheel-type chair back. This ensures the power transmission of one-way driving in the above-mentioned devices without slipping. When the disclosed one-way ratchet wheel element is used on the flywheels of a bicycle, it can absorb the instantaneous impact produced when stepping on the bicycle flywheels due to the wedge effect, in addition to smoother and silent idle state. Thus, the invention is more durable.

Although the invention has been described with reference to specific embodiments, this description is not meant to be construed in a limiting sense. Various modifications of the disclosed embodiments, as well as alternative embodiments, will be apparent to people skilled in the art. Therefore, it is contemplated that the appended claims will cover all modifications that fall within the true scope of the invention.

What is claimed is:

1. A one-way ratchet wheel element, comprising:

a body having a first hole disposed with a driving wheel and a second hole, wherein the central portion of the driving wheel is formed with a transmission part for rotating a rotating element, the outer surrounding surface of the driving wheel is formed with a first tooth part, the direction for the body to rotate the driving wheel is defined as a driving direction, the side of the second hole toward the driving direction has a shifting space, and the opposite wedge of the second hole on the other side of the shifting space is formed with an engaging tooth section composed of a plurality of continuous small teeth; and a driven wheel disposed in the second hole of the body, wherein the outer surrounding surface thereof is formed with a second tooth part to engage with the first tooth part and a blocking tooth part to engage with the engaging tooth section of the second hole, the driven wheel is driven by the driving wheel to roll toward the engaging tooth section on the opposite wedge on the other side of the shifting space, the blocking tooth part then engages with the engaging tooth part to form an engagement state, and when the body rotates opposite to the driving direction the blocking tooth part of the driven wheel rolls away from the engaging tooth section on the opposite wedge to enter an idle state.

2. The one-way ratchet wheel element of claim 1, wherein the second tooth part of the driven wheel and the blocking tooth part surround the outer surrounding surface of the driven wheel at different heights.

3. The one-way ratchet wheel element of claim 1, wherein the body consists of two opposite sideboards and the end surfaces of the two sideboards are formed with a first hole and a second hole.

4. The one-way ratchet wheel element of claim 3, wherein the second tooth part and the blocking tooth part of the driven wheel surround the outer surrounding surface of the driven wheel at different heights.

5. The one-way ratchet wheel element of claim 1, wherein the second hole is further divided into a first interval and a second interval, the side of the body opposite to the second hole is provided with an elastic urging element connected to the second hole, the driven wheel performs a switching action between the first interval and the second interval, the elastic urging element urges and restricts the driven wheel in one of the intervals, an engaging tooth section is formed in each of the two intervals, and the engaging tooth sections of the two intervals are opposite to each other.

6. The one-way ratchet wheel element of claim 5, wherein the outer surrounding surface of the driving wheel and the driven wheel is connected with a switching element for the driven wheel to switch between the first interval and the second interval.

7. The one-way ratchet wheel element of claim 1, wherein the blocking tooth part is formed at the end surface of each of the tooth peaks of the second tooth part on the driven wheel, and the second tooth part and the blocking tooth part surround the outer surrounding surface of the driven wheel at the same height.

* * * * *